US009872540B2

(12) United States Patent
Ito

(10) Patent No.: US 9,872,540 B2
(45) Date of Patent: Jan. 23, 2018

(54) RIVET

(71) Applicant: YKK Corporation, Tokyo (JP)

(72) Inventor: Nobuhisa Ito, Tokyo (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 15/508,805

(22) PCT Filed: Sep. 8, 2014

(86) PCT No.: PCT/JP2014/073721
§ 371 (c)(1),
(2) Date: Mar. 3, 2017

(87) PCT Pub. No.: WO2016/038666
PCT Pub. Date: Mar. 17, 2016

(65) Prior Publication Data

US 2017/0273410 A1 Sep. 28, 2017

(51) Int. Cl.
*A44B 1/42* (2006.01)
*A44B 1/28* (2006.01)
*A44B 1/08* (2006.01)

(52) U.S. Cl.
CPC ..... *A44B 1/42* (2013.01); *A44B 1/08* (2013.01); *A44B 1/28* (2013.01)

(58) Field of Classification Search
CPC ..... Y10T 24/3611; Y10T 24/3613; Y10T 24/3615; Y10T 24/363; A44B 1/26;
(Continued)

(56) References Cited

U.S. PATENT DOCUMENTS 1,583,472 A 5/1926 King
1,646,053 A * 10/1927 Clark ..... A44B 1/44 24/95

(Continued)

FOREIGN PATENT DOCUMENTS

EP 753271 A1 1/1997
JP 09-262109 A 10/1997

(Continued)

OTHER PUBLICATIONS

International Preliminary Report on Patentability, PCT International Patent Application No. PCT/JP2014/073721, dated Mar. 23, 2017.

(Continued)

*Primary Examiner* — Abigail E Troy
(74) *Attorney, Agent, or Firm* — Kilpatrick Townsend & Stockton LLP

(57) ABSTRACT

A rivet is applied from a rear surface of a fabric for mounting a burr on a front surface of the fabric. The rivet comprises a disk-shaped base, and a shank projecting from and concentrically with the base. The base includes an annular recess around a proximal end of the shank, which is depressed in a direction opposite to the shank-projecting direction, and a flange radially outward from the recess. The flange includes a plurality of bumps which are raised from an upper surface in the shank-projecting direction. The bumps may be provided on the upper surface of the flange at equal circumferential intervals, and a top of each of the bumps may be a curved face. The recess may have an inclined outer surface adjacent to the flange. Each of the bumps may have an inclined inner surface extending continuously from the inclined outer surface of the recess.

6 Claims, 7 Drawing Sheets

(58) Field of Classification Search
CPC .... A44B 1/28; A44B 1/42; A44B 1/44; A44B 1/08; A44B 17/0035
See application file for complete search history.

(56) References Cited

U.S. PATENT DOCUMENTS 4,570,307 A * 2/1986 Kanzaka ..... A44B 1/08 24/114.4
4,571,780 A * 2/1986 Fukuroi ..... A44B 1/44 24/114.4
4,607,415 A * 8/1986 Fukuroi ..... A44B 1/44 24/113 R
4,751,771 A * 6/1988 Watanabe ..... A44B 1/08 24/114.4
5,016,368 A * 5/1991 Cassata ..... G09F 3/12 24/108
5,173,997 A * 12/1992 Takezawa ..... B60R 22/023 24/104
5,575,043 A * 11/1996 Candotti ..... A44B 1/34 24/103
6,457,213 B2 * 10/2002 Watanabe ..... A44B 1/28 24/113 R
7,013,539 B2 * 3/2006 Fildan ..... A44B 17/0035 2/265
7,251,865 B2 * 8/2007 Takamura ..... A44B 1/08 24/113 MP
7,617,575 B2 * 11/2009 Sugihara ..... A44B 17/0035 24/691
7,752,718 B2 * 7/2010 Fisher ..... A44B 17/0035 24/114.4
8,522,403 B2 * 9/2013 Hayashi ..... A44B 1/34 24/101 R
2005/0160562 A1 7/2005 Hasegawa et al.
2014/0017512 A1 1/2014 Iimori et al.

FOREIGN PATENT DOCUMENTS

JP 2005-204911 A 8/2005
JP 3181363 U 1/2013
JP 2014-019953 A 2/2014
JP 2014-145404 A 8/2014

OTHER PUBLICATIONS

International Search Report, PCT International Patent Application No. PCT/JP2014/073721, dated Nov. 25, 2014.

* cited by examiner

RIVET

This application is a national stage application of PCT/JP2014/073721, which is incorporated herein by reference.

BACKGROUND OF THE INVENTION

The present invention relates to a rivet and, more particularly, to a rivet (tack) for use in, for instance, reinforcing jeans pockets.

At positions in jeans such as opening-side ends of a pocket, reinforcements referred to as bar tacking is generally made by two members, namely, a rivet and a burr as shown in e.g. JP2014-19953, A, U.S. Pat. No. 1,583,472, etc. Such a burr may serve as decorations for jeans. The burr is a decorative button made of copper, brass, etc. and comprises a central, domy and hollow protrusion and an annular plate-shaped, outer periphery extending radially outward from the proximal end of the protrusion. The rivet is a metal tack for attaching the burr to a front surface of a fabric by applying the rivet from a rear surface of the fabric, and comprises a disk-shaped base and a shank projecting from the base. When the burr is attached to the fabric, using a riveter, the shank of the rivet is caused to pierce the fabric from its rear surface towards the burr, which is held on the front surface of the fabric, and then the shank is swaged within the inner space of the protrusion of the burr.

Recently, elasticized denim fabric and thin denim fabric have been developed, and jeans made of those fabrics are commonly available. When conventional rivet and burr are applied to such an elasticized or thin fabric, the fabric would not be sufficiently held between the burr and the rivet. In this case, if a fabric part around the rivet is pulled by a laterally pulling force, the fabric would be displaced, and after the laterally pulling force is released, the fabric would not be totally restored, causing wrinkles. Alternatively, the fabric hole through which the shank of the rivet penetrates would expand, causing a problem that the rivet or burr would come off from the fabric. For these reasons, the rivet and burr cannot be applied to jeans made of an elasticized or thin fabric.

[Patent Document 1] JP2014-19953, A

[Patent Document 2] U.S. Pat. No. 1,583,472

In the light of the problems as mentioned above, an object of the present invention is to provide a rivet, which can be effectively applied to elasticized fabric or thin fabric.

SUMMARY OF THE INVENTION

To solve the above-mentioned problems, according to the present invention, there is provided a rivet to be applied from a rear surface of a fabric for mounting a burr on a front surface of the fabric, comprising a disk-shaped base, and a shank projecting from and concentrically with the base, wherein the base includes an annular recess around a proximal end of the shank, the recess being depressed in a direction opposite to the shank-projecting direction, and a flange radially outward from the recess, wherein the flange includes a plurality of bumps which are raised from an upper surface of the flange in the shank-projecting direction.

In the invention, since the plurality of the bumps are provided on the upper surface of the flange, which is a part radially outward from the recess of the base of the rivet, when the burr is mounted to the fabric with the rivet, the fabric is held between the burr and the base of the rivet, coming into the recess of the base. Further, the fabric is partially compressed against the burr by each of the bumps at equal circumferential intervals. Thus, an elasticized fabric or a thin fabric can be securely held to the burr by each of the bumps, and if the fabric around the rivet is pulled, the fabric will not be easily displaced.

In the invention, the burr is a decorative button to be mounted to, for instance, opening-side ends of a pocket in jeans for reinforcements or decorations, and it is commonly made of copper, brass, etc., but not limited thereto. The rivet is a tack for attaching the burr to a fabric, and it is commonly made of metal such as iron, copper, aluminum, nickel, titanium, zinc, or alloy thereof, but the rivet may be made of resin.

In an embodiment of the invention, the bumps are provided on the upper surface of the flange at equal circumferential intervals, and a top of each of the bumps is a curved face. Since the top of each of the bumps is a curved face, they would not damage a fabric.

In an embodiment of the invention, the recess has a bottom surface and an inclined outer surface extending from the bottom surface and adjacent to the flange, the inclined outer surface being inclined radially outward and upward, and each of the bumps has an inclined inner surface extending continuously from the inclined outer surface of the recess. In this case, since the inclined inner surface of each of the bumps raised from the upper surface of the flange extends continuously from the inclined outer surface of the recess of the base of the rivet, if the fabric around the rivet is pulled, the bumps will catch on the fabric largely. It is believed that this also contributes to preventing the fabric from being displaced.

In an embodiment of the invention, the inclined angle of the inclined inner surface of each bump is different from the inclined angle of the inclined outer surface of the recess. Since the inclined angle of the inclined inner surface of each bump is different from that of the inclined outer surface of the recess, the inclined outer surface of the recess has a wave shape in the circumferential direction by the inclined inner surface of each bump.

In an embodiment of the invention, the inclined inner surface of each bump is raised from the inclined outer surface on the bottom surface-side of the recess relative to the upper surface of the flange. This can make the rivet catch on the fabric largely. Further, in an embodiment of the invention, the length of each bump along the circumferential direction of the base of the rivet is longer than the length of each bump along the radial direction of the base.

In the present invention, since the plurality of the bumps are provided on the upper surface of the flange, which is a part radially outward from the recess of the base of the rivet, when the burr is mounted to the fabric with the rivet, the fabric is held between the burr and the base of the rivet, coming into the recess of the base. Further, the fabric is partially compressed against the burr by each of the bumps at equal circumferential intervals. Thus, an elasticized fabric or a thin fabric can be securely held to the burr, and if the fabric around the rivet is pulled, the fabric will not be easily displaced. The rivet according to the invention can be effectively applied to jeans and the like made of an elasticized or thin fabric.

DETAILED DESCRIPTION OF THE INVENTION

Figure 1:
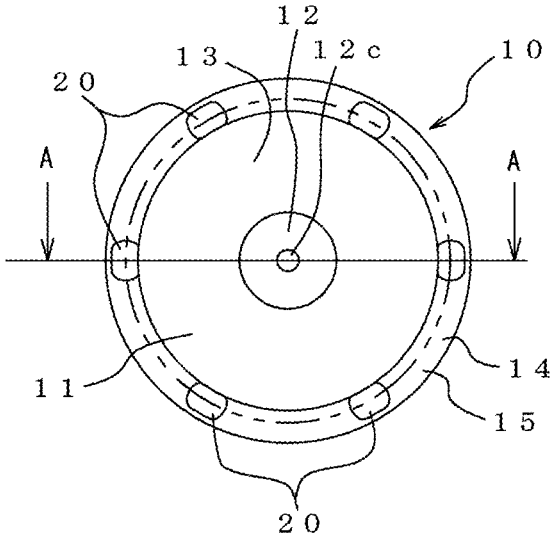
FIG. 1 is a top view of a rivet according to an embodiment of the present invention.
Figure 2:
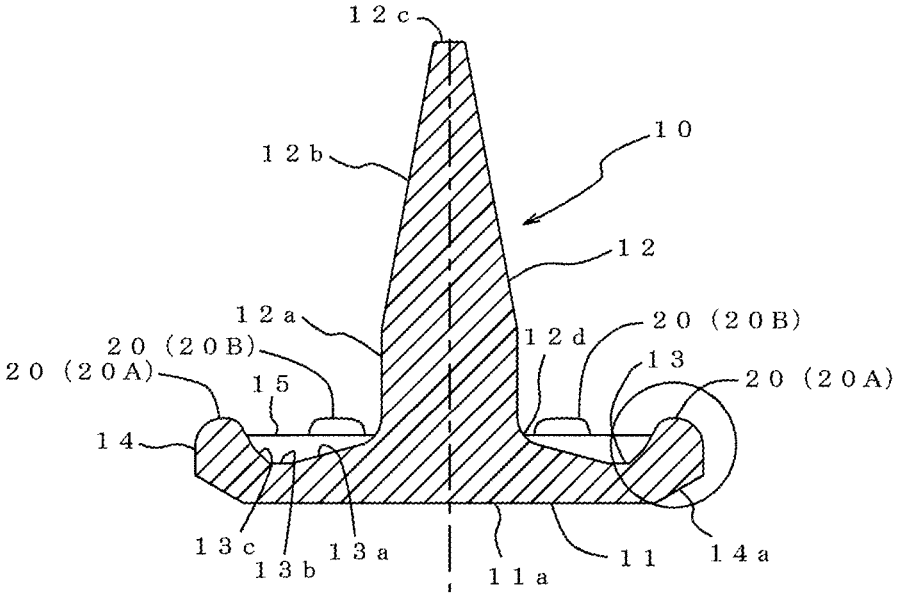
FIG. 2 is a cross-sectional view taken along line A-A in FIG. 1.
Figure 3:
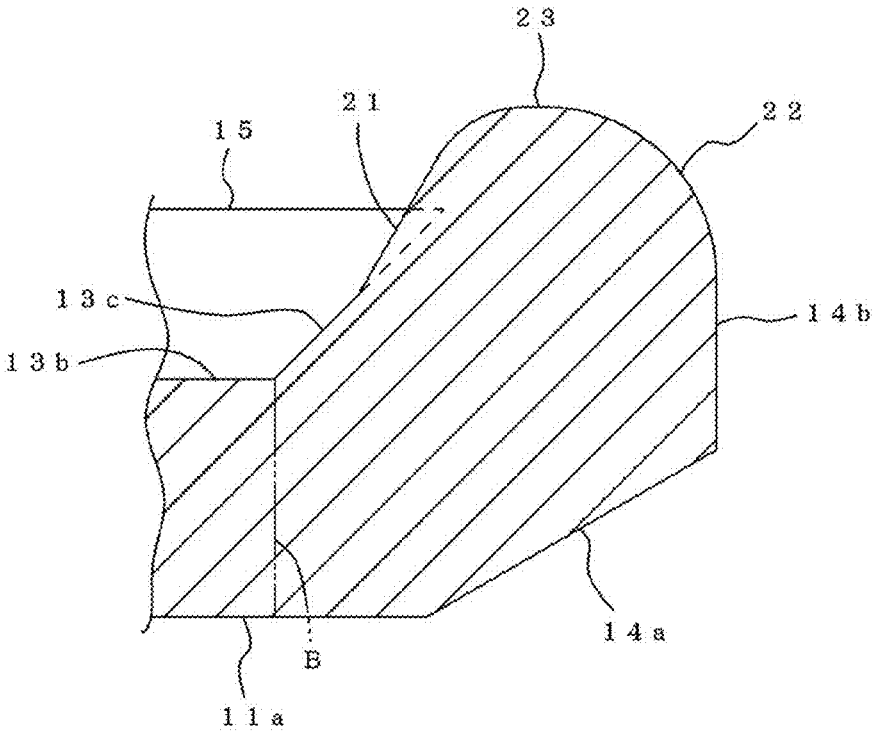
FIG. 3 is an enlarged view of the part circled in FIG. 2.

Hereinafter, preferred embodiments of a rivet according to the present invention will be described with referring to the drawings. However, the present invention is not limited to the embodiments, and those skilled in the art will appreciate that suitable modifications and the like can be made within the scope of the claims and the range of equivalents. FIG. 1 is a top view of a rivet 10 according to the present invention. FIG. 2 is a cross-sectional view of the rivet 10 taken along line A-A in FIG. 1. FIG. 3 is an enlarged view of the part circled in FIG. 2. The rivet 10 is a metal tack and can be formed by cold forging metal material such as iron, copper, aluminum, nickel, titanium, zinc and alloy thereof, etc. The rivet 10 comprises a disk-shaped base 11 and a solid shank 12 projecting upward (hereinafter, an up-and-down direction is based on FIGS. 2-5, 7 and 8) from a central area of the base 11 concentrically therewith. The shank 12 includes a lower, shank barrel 12*a* having an approximately constant outer diameter and a shank head 12*b* extending upward from the upper end of the shank barrel 12*a* while gradually reducing its outer diameter. The tip 12*c* of the shank head 12*b*, namely the tip 12*c* of the shank 12 is a flat, small circle. The lower end 12*d* of the shank barrel 12*a*, namely the proximal end 12*d* of the shank 12 is positioned at the same level in the up-and-down direction as with an upper surface 15 of a flange 14 of the base 11 as described later.

The base 11 of the rivet 10 includes an annular recess 13, in its upper surface-side, which is depressed downward around the proximal end 12*d* of the shank 12, and a flange 14, which is a portion radially outward from the recess 13 of the base 11. Although the recess 13 and the flange 14 would not be clearly distinguished from each other, in this specification, the above-wording of "a portion radially outward from the recess 13" means the portion radially outward from the broken line B in FIG. 3. The recess 13 is defined by an inclined inner surface 13*a* extending radially outward and inclining gently downward from the proximal end 12*d* of the shank 12; a bottom surface 13*b* somewhat extending horizontally (a horizon is along on any plane perpendicular to the up-and-down direction, namely the axial direction of the shank 12) and radially outward from the radially outer end of the inclined inner surface 13*a*; and an inclined outer surface 13*c* extending radially outward and upward from the radially outer end of the bottom surface 13*b*. The inclined outer surface 13*c* has an inclined angle larger than that of the inclined inner surface 13*a*. The inclined angle of the inclined outer surface 13*c* can be set to between 40 to 80 degrees as an example. In this embodiment, the inclined angle of the inclined outer surface 13*c* is 45 degrees. The bottom surface 13*b* defines a deepest bottom of the recess 13. The lower surface 11*a* of the base 11 except for the flange 14 is horizontal and parallel to the bottom surface 13*b* of the recess 13. The lower surface 11*a* extends to the flange 14, and the radially outer end of the lower surface 11*a* is at approximately the same radial position as with the upper end of the inclined outer surface 13*c* of the recess 13. The flange 14 has a lower surface 14*a* inclining radially outward and upward from the radially outer end of the lower surface 11*a*. The inclined angle of the lower surface 14*a* is smaller than the inclined angle of the inclined outer surface 13*c* of the recess 13. The upper surface 15 of the flange 14 is horizontal, and on the upper surface 15, six bumps 20 as an example are formed at 60 degree intervals in the circumferential direction as described in detail later. An outer periphery surface 14*b* of the flange 14, namely an outer periphery surface 14*b* of the base 11 is approximately along the up-and-down direction, but the outer periphery surface 14*b* slightly curves radially inward in the vicinity of the upper surface 15 and intersects with the upper surface 15. An inclined inner surface 13*c* of the flange 14 is the inclined outer surface 13*c* of the recess 13, and the inclined outer surface 13*c* of the recess 13 except for the portions corresponding to the bumps 20 intersects with the upper surface 15 of the flange 14.

Next, the bumps 20 of the flange 14 will be described. The length of each of the bumps 20 in the circumferential direction of the flange 14 is longer than the length of each bump 20 in the radial direction of the base 11. The form of each bump 20 along the upper surface 15 of the flange 14 is approximately an ellipse. In the outline of each bump 20, there are no corners and pointed portions, and a top of each bump 20 is formed by a smooth, curved face. This regard will be explained further in detail below. In FIG. 2, two bumps 20 (20A) are shown in the cross-sectional view along the radial direction, and another two bumps 20 (20B) are shown in the longitudinal outline view along the circumferential direction. FIG. 3 is a view enlarging a cross-sectional portion around the bump in FIG. 2. The bump 20 includes one or more side faces and a top face 23 to which the one or more side faces connect smoothly and in a curved form. In each bump 20, the length along the circumferential direction of the base 11 of the rivet 10 is longer than the length along the radial direction of the base 11. The top face 23 of each bump 20 is approximately flat in the circumferential direction. Each bump 20 includes an inclined inner surface 21 as described in detail later and an inclined outer surface 22 on the opposite side to the inclined inner surface 21. The inclined outer surface 22 connects the outer periphery surface 14*b* of the flange 14 to the top face 23 smoothly. As can be seen from FIGS. 2 and 3, each bump 20 projects from the upper surface 15 of the flange 14 in the shank 12-projecting direction, and the bumps 20 are arranged at equal circumferential direction. Further, according to this embodiment, each bump 20 includes an inclined inner surface 21 facing to the shank 12. The inclined inner surface 21 extends continuously from the inclined outer surface 13*c* of the recess 13, and the boundary between the inclined inner surface 21 and the inclined outer surface 13*c* is on the bottom-side from the upper surface 15 of the flange 14. The inclined inner surface 21 of the bump 20 is longer in the up-and-down direction than the inclined outer surface 22 on the opposite side to the inclined inner surface 21. The inclined angle of the inclined inner surface 21 is lager that the inclined angle of the inclined outer surface 13*c* of the recess 13. In other words, the inclined inner surface 21 of each bump 20 is steeper than the inclined outer surface 13*c* of the recess 13. Thus, on an inner periphery surface of the flange 14, there is a wave shape in the circumferential direction by the inclined inner surface 21 of each bump 20 and the inclined outer surface 13*c* of the recess 13. Further, it can be said that each bump 20 bulges upward from the upper surface 15 of the flange 14 and radially inward toward the shank 12. With reference to FIG. 3, the inclined inner surface 21 of the bump 20 extends upward from approximately the midpoint, in the up-and-down direction, of the inclined outer surface 13*c* of the recess 13, with an inclined angle slightly larger than the inclined angle of the inclined outer surface 13*c* by e.g. more than 0 to less than or equal to 3 degrees.

In this embodiment, the six bumps 20 are provided in the rivet 10, but the number of bumps is not limited thereto. Another example with three bumps will be explained later (see FIG. 5). As standards of the number of bumps to be provided, the following two are cited. 1) A ratio of the entire area of the upper surface 15 of the flange 14 of the rivet 10 including the portions corresponding to the bumps 20 to the total area of the bumps 20 along the upper surface 15 is preferably between 8.5% and 24.5%. 2) A ration of the entire length of the flange 14 (the length along the two-dot chain line in FIG. 1 at the midpoint of the radial width of the flange) including the portions corresponding to the bumps 20 to the total length of the bumps 20 (along the two-dot chain line in FIG. 1) in the circumferential direction of the flange 14 is preferably between 11% to 24%. In the light of the standards 1) and 2) and actual designing specifications of the rivet 10, a preferable number of bumps are between 3 and 6. In this embodiment, the ratio of the entire area of the upper surface 15 of the flange 14 of the rivet 10 including the portions corresponding to the bumps 20 to the total area of the bumps 20 along the upper surface 15 is approximately 4.5%. Further, the ration of the entire length of the flange 14 including the portions corresponding to the bumps 20 to the total length of the bumps 20 in the circumferential direction of the flange 14 is approximately 24%.

Figure 4:
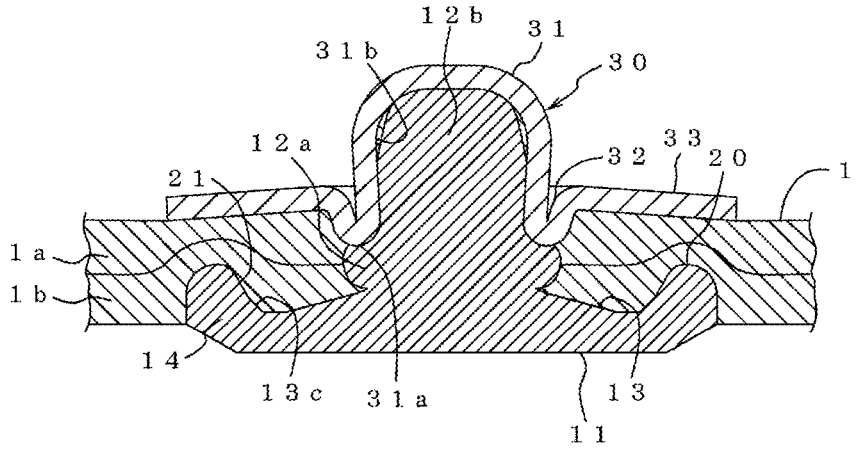
FIG. 4 is a cross-sectional view showing a state where a burr is mounted to a fabric using the rivet.

FIG. 4 is a cross-sectional view showing a state where a burr 30 is mounted to a fabric 1 using the rivet 10 as described above. The fabric 1 is stretchable and includes elastic fibers formed such as by weaving or knitting elastic threads. In this state, the shank 12 of the rivet 10 is plastically deformed as described later. The fabric 1 is a denim fabric formed by laminating an outer material 1*a* with a lining 1*b*. The burr 30 is a decorative button formed by drawing a brass plate, and comprises a central, domy and hollow protrusion 31, a folded portion 32 somewhat extending radially outward and upward from the proximal end 31*a* of the protrusion 31, and an annular plate-shaped, outer periphery 33 extending radially outward from the upper end of the folded portion 32 while slightly inclining downward. The protrusion 31 defines an inner space 31*b*, and an upper end of the space 31*b* is closed and a lower end of the space 31*b* is open. A diameter of the inner space 31*b* slightly and gradually expands downward from the upper closed end to the maximum and then slightly and gradually shrinks further downward. The outer diameter of the outer periphery 33 is slightly larger than the outer diameter of the base 11 of the rivet 10. When the burr 30 is attached to the fabric 1 with the rivet 10, using a riveter as not shown, the shank 12 of the rivet 10 is caused to pierce the fabric 1 from its rear surface towards the burr 30, which is held on the front surface of the fabric 1, and then the shank 12 is swaged within the inner space 31*b* of the protrusion 31 of the burr 30. Thereby, as shown in FIG. 4, the shank head 12*b* is plastically deformed so as to fill the inner space 31*b* of the protrusion 31 of the burr 30, and the shank barrel 12*a* collapses in the up-and-down direction and expands in the radial direction. Since the diameter of the inner space 31*b* of the protrusion 31 slightly shrinks downward, the plastically deformed shank head 12*b* becomes unable to come off the protrusion 31.

In the rivet-mounted state in FIG. 4, the fabric 1 is held between the base 11 of the rivet 10 and the outer periphery 33 of the burr 30, coming into the recess 13 of the base 11. Further, the fabric 1 is partially compressed against the outer periphery 33 of the burr 30 by the six bumps 20 of the flange 14 of the rivet 10 at 60-degree circumferential intervals. Since the fabric 1 is secured by the bumps 20 in this way, if the fabric 1 is pulled away from the shank 12 (hereinafter referred to as "laterally"), the fabric 1 will not be easily displaced. Furthermore, when the fabric 1 is pulled laterally, the bumps 20 will catch on the fabric 1 largely because the inclined inner surface 21 of each of the bumps 20 is slightly steeper than the inclined outer surface 13*c* of the recess 13. It is believed that this also contributes to preventing the fabric 1 from being displaced. It is also believed that the inclined inner surface 21 and the inclined outer surface 13*c* having the circumferentially wave shape on the inner periphery surface of the flange 14 contributes to the prevention of the fabric's displacement. Further, since the bottom surface 13*b* of the recess 13, namely the deepest portion of the recess 13 is located nearer the flange 14 than the shank 12, the fabric 1 is easy to contact the inclined inner surface 21, which is deemed to contribute to the prevention of the fabric's displacement, too.

Figure 5:
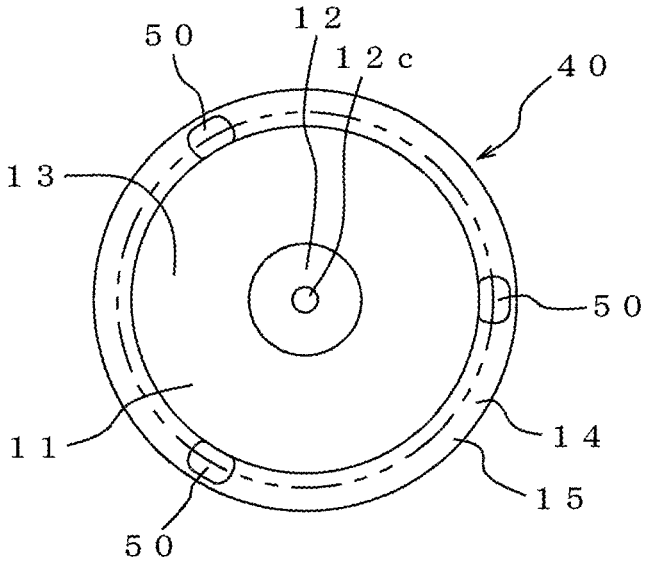
FIG. 5 is a top view of a rivet according to another embodiment of the present invention.

FIG. 5 is a top view of a rivet according to another embodiment of the present invention. This rivet 40 is the same as the rivet 10 as described above except that three bumps 50 are provided in the rivet 40 at 120 degree intervals in the circumferential direction. Thus, the same reference numerals as for the rivet 10 are used without explaining for them except for reference numerals 40, 50. Each of the bumps 50 has the same shape as the bump 20 as described above, and therefore each bump 50 includes the inclined inner surface 21 as well. A ratio of the entire area of the upper surface 15 of the flange 14 of the rivet 40 including the portions corresponding to the bumps 50 to the total area of the bumps 50 along the upper surface 15 is approximately 8.5%. A ration of the entire length of the flange 14 including the portions corresponding to the bumps 50 to the total length of the bumps 50 in the circumferential direction of the flange 14 is approximately 11%.

Figure 6:
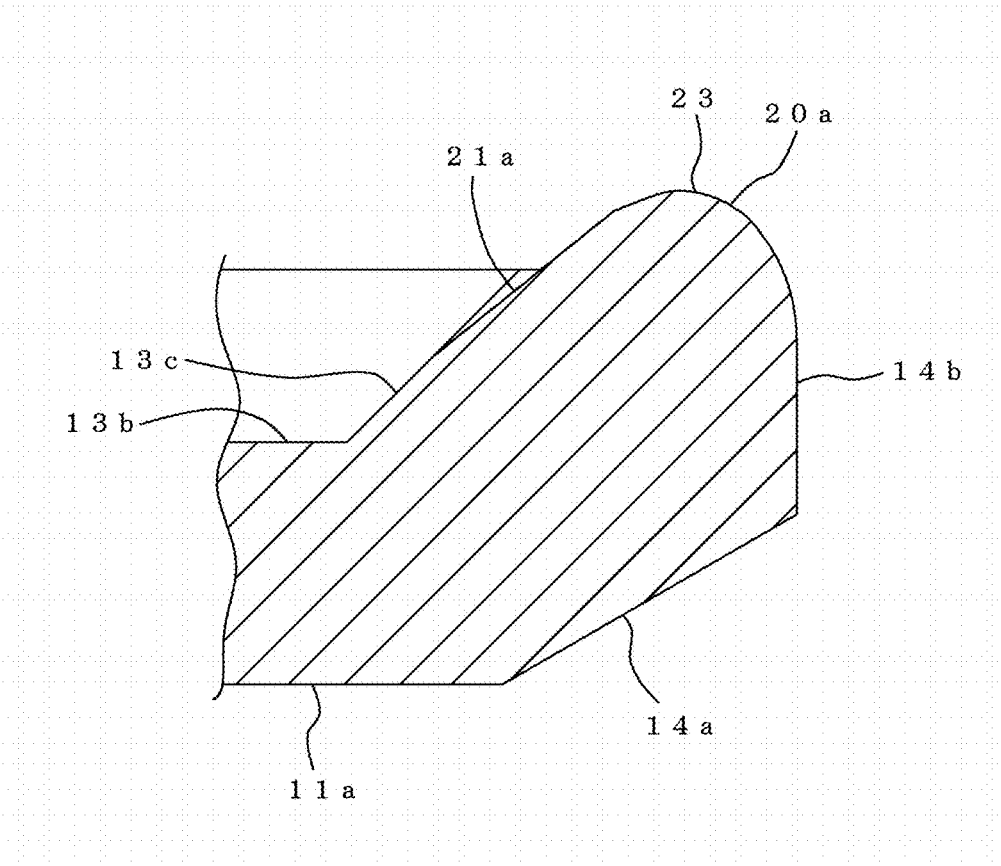
FIG. 6 is an enlarged view similar to FIG. 3, showing a modification of a bump.
Figure 7:
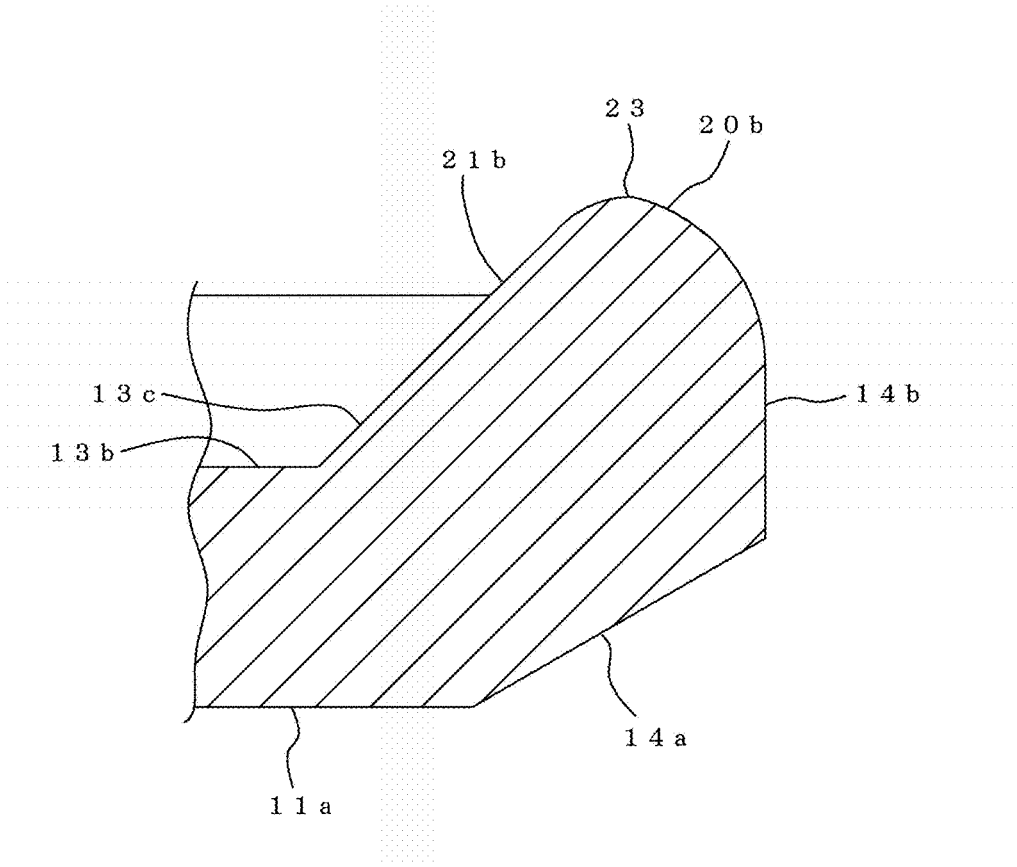
FIG. 7 is an enlarged view similar to FIG. 3, showing another modification of a bump.

FIG. 6 is an enlarged view similar to FIG. 3, showing a bump 20*a* as a modification of the bump 20 of the rivet 10 as described above. An inclined inner surface 21*a* of each bump 20*a* extends upward from approximately the midpoint, in the up-and-down direction, of the inclined outer surface 13*c* of the recess 13 (the same reference numerals are used as in FIG. 3 except for the bump 20*a* and its inclined inner surface 21*a*; Same is true of FIG. 7), with an inclined angle slightly smaller than the inclined angle of the inclined outer surface 13*c* by e.g. more than 0 to less than or equal to 3 degrees. Thus, on an inner periphery surface of the flange 14, there is a wave shape in the circumferential direction by the inclined inner surface 21*a* of each bump 20*a* and the inclined outer surface 13*c* of the recess 13. FIG. 7 is an enlarged view similar to FIG. 3, showing a bump 20*b* as another modification of the bump 20 of the rivet 10 as described above. An inclined inner surface 21*b* of each bump 20*b* extends upward with the same inclined angle as with the inclined outer surface 13*c* of the recess 13. It is believed that the inclined inner surfaces 21*a*, 21*b* of the bumps 20*a*, 20*b* contributes to preventing the fabric 1 from being displaced as compared to a conventional rivet, because the bumps 20*a*, 20*b* will catch on the fabric 1 largely when the fabric 1 to which the burr 20 is mounted with the rivet 10 is pulled laterally, even if each inclined inner surface 21*a*, 21*b* of each bump 20*a*, 20*b* is the same or approximately the same inclined angle with the inclined outer surface 13*c* of the recess 13, which is relatively steep.

REFERENCE SIGNS LIST

1 fabric
10, 40 rivet
11 base
12 shank
13 recess
13*c* inclined outer surface
14 flange
15 upper surface of the flange
20, 20*a*, 20*b*, 50 bump
21, 21*a*, 21*b* inclined inner surface of the bump
30 burr
31 protrusion
33 outer periphery

The invention claimed is:

1. A rivet to be applied from a rear surface of a fabric for mounting a burr on a front surface of the fabric, comprising a disk-shaped base, and a shank projecting from and concentrically with the base, wherein the base includes an annular recess around a proximal end of the shank, the recess being depressed in a direction opposite to the shank-projecting direction, and a flange radially outward from the recess, wherein the flange includes a plurality of bumps which are raised from an upper surface of the flange in the shank-projecting direction, wherein the recess has a bottom surface and an inclined outer surface extending from the bottom surface and adjacent to the flange, the inclined outer surface being inclined radially outward and upward, and wherein each of the bumps has an inclined inner surface extending continuously from the inclined outer surface of the recess.

2. The rivet according to claim 1, wherein the bumps are provided on the upper surface of the flange at equal circumferential intervals, and a top of each of the bumps is a curved face.

3. The rivet according to claim 2, wherein a length of each bump along a circumferential direction of the base of the rivet is longer than a length of each bump along a radial direction of the base.

4. The rivet according to claim 1, wherein an inclined angle of the inclined inner surface of each bump is different from an inclined angle of the inclined outer surface of the recess.

5. The rivet according to claim 4, wherein the inclined inner surface of each bump is raised from the inclined outer surface of the recess at a location lower than the upper surface of the flange.

6. The rivet according to claim 1, wherein a length of each bump along a circumferential direction of the base of the rivet is longer than a length of each bump along a radial direction of the base.

* * * * *